US005297301A

United States Patent [19]

Sodrel

[11] Patent Number: 5,297,301

[45] Date of Patent: Mar. 29, 1994

[54] CULTURED MARBLE SHOWER STALL WITH RAISED EDGE

[76] Inventor: Robert E. Sodrel, Rte. 1 Box 1020, LaBelle, Fla. 33935

[21] Appl. No.: 982,765

[22] Filed: Nov. 27, 1992

[51] Int. Cl.[5] ..... A47K 3/16

[52] U.S. Cl. ..... 4/613; 4/609; 4/610; 52/34

[58] Field of Search ..... 4,/599, 596, 610, 612, 4,/613, 614, 584, 591, 592, 593, 595, 609; 52/264, 34, 35, 173 R, 173.1

[56] References Cited

U.S. PATENT DOCUMENTS

| | | | |
|---|---|---|---|
| 999,858 | 8/1911 | Payne | 4/612 |
| 2,993,212 | 7/1961 | Ruhm | 52/34 |
| 4,316,295 | 2/1982 | Whitney et al. | 52/34 |
| 4,423,528 | 1/1984 | Wiedmaier | 4/613 |
| 4,901,380 | 2/1990 | Smith | 52/34 |
| 4,974,269 | 12/1990 | Baus | 4/613 |
| 5,159,723 | 11/1992 | Benedict | 52/34 |

FOREIGN PATENT DOCUMENTS

| | | | |
|---|---|---|---|
| 2108382 | 5/1983 | United Kingdom | 4/613 |

*Primary Examiner*—Henry J. Recla
*Assistant Examiner*—Charles R. Eloshway
*Attorney, Agent, or Firm*—William E. Noonan

[57] ABSTRACT

A one piece shower stall is disclosed. The shower stall includes a generally horizontal base portion and a side wall portion that is unitarily interconnected to and extends upwardly from the base portion. The side wall portion terminates in an upper ledge having a generally horizontal upper surface that is sufficiently wide to support at least one of an outer wall covering and a shower door mechanism. A raised rim portion is unitarily interconnected to and surrounds the ledge. The rim portion includes a generally vertical surface for engaging at least one of an outer wall covering and a shower door mechanism and a continuous, generally horizontal surface that extends outwardly from the vertical surface to a periphery of the shower stall for supporting an inner wall covering.

15 Claims, 2 Drawing Sheets

CULTURED MARBLE SHOWER STALL WITH RAISED EDGE

BACKGROUND OF THE INVENTION

While it is desirable to build shower stalls and bath tubs of constructions that are as strong as possible, and are as free as possible from the leaking of water, it is desirable to eliminate the possibilities of the leaking of water all together.

So many complaints have been raised to the fact that shower bases and tubs leak water around their upper edge where they contact other building materials that your applicant devoted his attention to this problem, and has succeeded in overcoming the leaks.

FIELD OF THE INVENTION

Shower stalls and bathtubs have been poured out of what is referred to as cultured marble for some time now. Generally they have been constructed in such a way as to have a bottom surface and four walls. In so much as they are poured in a mold and are generally poured upside down the walls have been flat or have had a tapered design. That is to say they have narrowed as they go up. The shower stall designs have needed to be able to be slipped out of a one piece mold. It has been difficult to formulate a method that would allow for a variety of different planes to exist in a single pour. The pressures that are generated during the pouring, setting, hardening and curing processes are such that many molds could not withstand the pressures.

DESCRIPTION OF THE PRIOR ART

It is common to fabricate shower stall and bathtubs of cultured marble. Until now the shower stalls have been poured so as to have a bottom horizontal surface terminating in vertical flat walls extending up to horizontal flat surfaces extending out to the outer edges. The unit would then be installed with the outer edges in contact with plasterboard or some other suitable inner wall material. Then an outer wall material such as cultured marble, tile board, ordinary tile or some other suitable waterproof material would be installed. This inner wall material would extend down to and be in contact with the horizontal flat surface of the shower stall and a sealant such as tub caulk would be used to seal the seam where the stall contacts the inner wall material. This solution would be satisfactory for some length of time but eventually the seal would become weakened and water would seep in through the seam and do damage to the materials behind and beneath the shower stall.

SUMMARY OF THE INVENTION

Briefly summarized my invention pertains to the addition of a raised rim of approximately ½" in height and ½" in width around the outer rim at the top of a shower stall or bathtub constructed of cultured marble. This shower stall or bathtub would be constructed in such a way as to be seamless and of one piece. After the installation of the shower stall or bathtub and the installation of an inner wall material that would rest on the horizontal ledge of my raised rim is completed, cultured marble or tile board or ordinary tile or some other suitable waterproof material is used as a covering on the outer walls. This outer wall covering would be installed so as to cover the exposed face of my raised rim and abut the horizontal surface beneath the raised rim. There would then be a completely waterproof seal between the shower stall and the walls surrounding it.

DESCRIPTION OF THE PREFERRED EMBODIMENT

Figure 1:
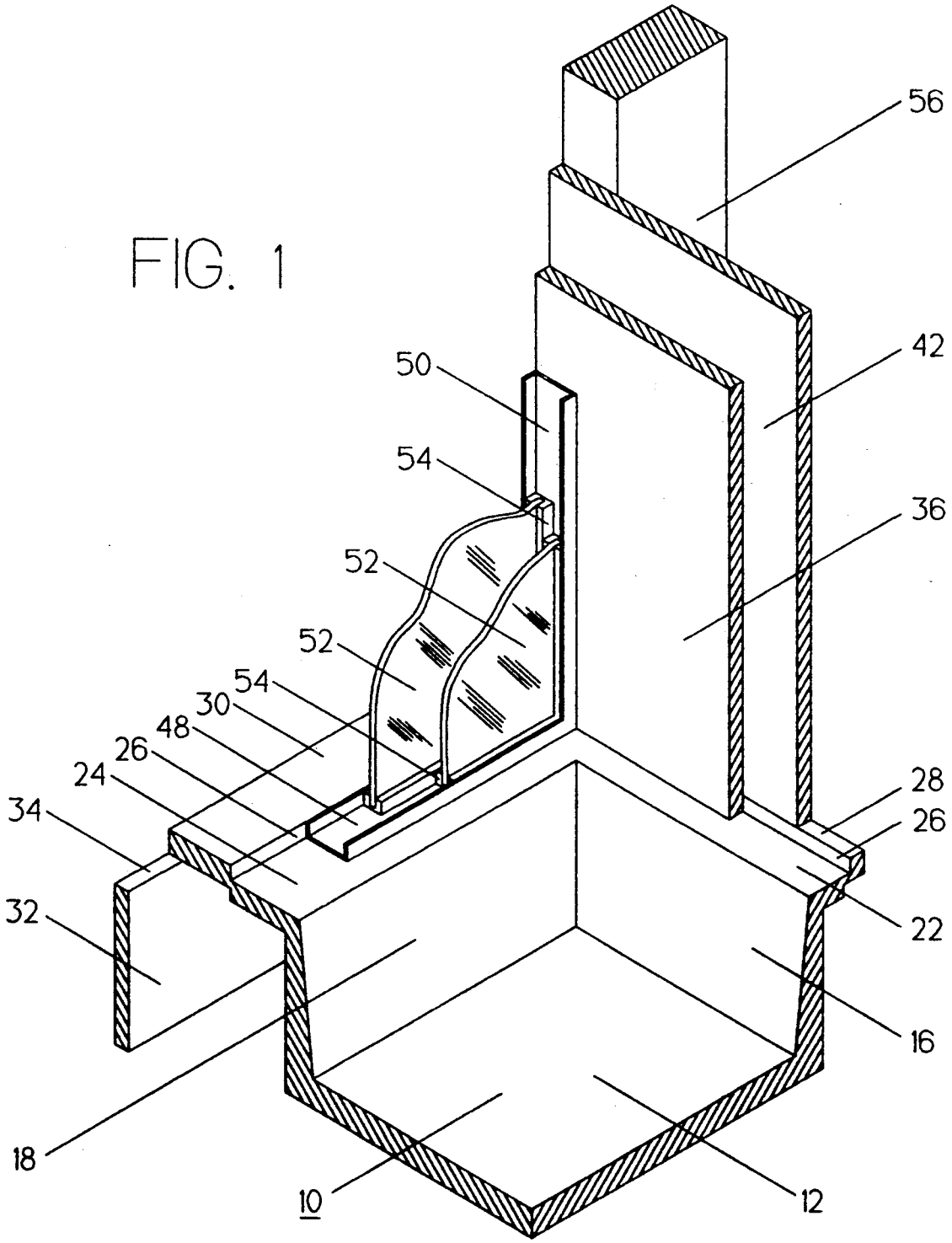
FIG. 1 is a perspective view showing a cutaway of a front corner of the shower stall as viewed from the opposite corner in the back of the shower stall and showing the access way into the shower stall.
Figure 2:
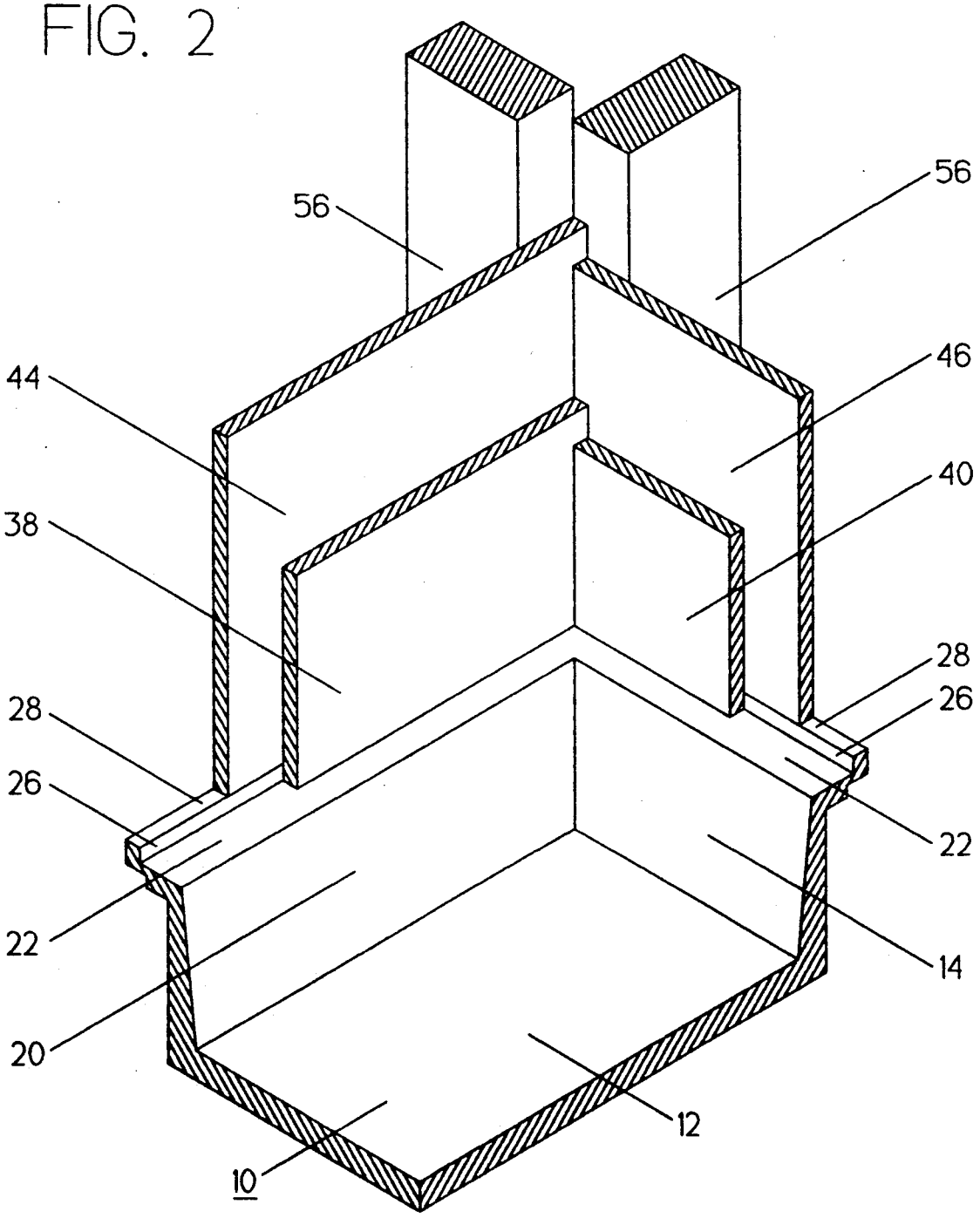
FIG. 2 is also a perspective view showing a cutaway of a back corner of the shower stall as viewed from the opposite corner in the front of the shower stall.

With reference now to the drawings in which like reference characters designate like elements throughout the two views and with particular reference to FIG. 1 and FIG. 2, the entire single pour one piece cultured marble shower stall is illustrated at 10. The side walls 14 and 16 each connect to the base 12 and the front wall 18 and the back wall 20 are. The front wall 18 and the back wall 20 both connected to the base 12 forming the pan of the shower stall.

There are three horizontal ledges 22 that extend outward around the top of the shower stall 10. A front ledge 24 on the same plane as the three ledges 22 has a slightly wider surface for the optional installation of a door mechanism 48 and 50 having glass doors 52. The most common usage of a closing device would be a simple shower curtain constructed of plastic or some other suitable material. There is an outer wall material 36, 38 and 40 made of cultured marble or tile board or ordinary tile or some other suitable waterproof material that rest on and contact surface 22 and are in contact with surface 26.

Directly behind the outer wall covering and in contact with them providing support are the inner wall coverings 42, 44, and 46 which are plaster board or some other suitable material use in construction. These materials are in contact with the shower stall and more specifically in contact at surfaces 28, horizontal surfaces approximately ½" wide which comprise the highest plane on the shower stall. These inner wall coverings are attached to building materials commonly used in the construction industry such as 2"×4" studs 56. There is a front horizontal ledge 30 that is on the same plain as the three surfaces 28 that will aid significantly in the prevention of water leakage out of the front of the shower stall during use. If the individual construction methods used during the installation of the shower stall permit it a closing plate 32 made of cultured marble can be added in the front of the shower stall to add cosmetic appeal to the shower stall.

I claim:

1. A shower stall comprising:

a generally horizontal, unitary base portion;

a side wall portion unitarily interconnected to and extending upwardly from said base portion, said wall portion completely surrounding said base portion and terminating in an upper ledge having a generally horizontal upper surface that completely surrounds said side wall portion and is sufficiently wide to support at least one of an outer wall covering and a shower door mechanism; and a raised rim portion unitarily interconnected to and completely surrounding said ledge, said rim portion including a generally vertical surface for engaging at least one of an outer wall covering and a shower door mechanism and a continuous, generally horizontal surface that extends sufficiently outwardly from said vertical surface to an outer periphery of said shower stall for supporting an inner wall covering thereon, said shower stall having a unitary, one piece construction.

2. The apparatus of claim 1 in which said side wall portion includes four integrally interconnected wall segments.

3. The apparatus of claim 2 in which said ledge includes four integrally connected ledge segments that correspond to respective said wall segments.

4. The apparatus of claim 3 in which each of said ledge segments includes a respective segment of said horizontal upper surface of said ledge and one of said ledge segments has a horizontal upper surface segment that is substantially wider than said horizontal upper surface segments of said remaining ledge segments for supporting a shower door mechanism thereon.

5. The apparatus of claim 3 in which said raised rim portion includes four rim segments that correspond to respective said ledge segments.

6. The apparatus of claim 5 in which each said rim segment includes a respective segment of said horizontal surface of said rim portion and one of said rim segments has a horizontal surface segment that is substantially wider than said horizontal surface segments of said remaining rim segments for defining an entry into said shower stall.

7. The apparatus of claim 1 in which said base portion, said ledge and said rim portion are seamlessly interconnected.

8. The apparatus of claim 1 in which a majority of said side wall portion is approximately 6" high.

9. The apparatus of claim 1 in which a majority of said side wall portion is approximately 12" high.

10. The apparatus of claim 1 is which said horizontal upper surface of said ledge is approximately 1½" wide.

11. The apparatus of claim 1 in which said vertical surface of said raised rim portion is approximately ½" thick.

12. The apparatus of claim 1 in which said horizontal surface of said raised rim portion is approximately ½" thick.

13. The apparatus of claim 1 in which said generally horizontal upper surface of said ledge is substantially flat.

14. The apparatus of claim 1 in which said horizontal surface of said rim portion is substantially flat.

15. A shower stall assembly comprising:

a one piece shower stall that has a generally horizontal, unitary base portion, a side wall portion unitarily interconnected to and extending upwardly from said base portion, said side wall portion completely surrounding said base portion and terminating in an upper ledge having a generally horizontal upper surface which completely surrounds said side wall portion, and a raised rim portion unitarily interconnected to and completely surrounding said ledge, said rim portion including a generally vertical surface that extends upwardly from said horizontal upper surface of said upper ledge and a continuous, generally horizontal surface that extends sufficiently outwardly from said vertical surface to an outer periphery of said shower stall;

an outer wall covering supported on said horizontal upper surface of said ledge and engaging said vertical surface of said raised rim portion; and an inner wall covering supported on said horizontal surface of said raised rim portion in contact with said outer wall covering.

* * * * *